US011987412B2

(12) United States Patent
Singh et al.

(10) Patent No.: US 11,987,412 B2
(45) Date of Patent: May 21, 2024

(54) SPIROFEED BRUSH BOX FOR A BLISTER MACHINE

(71) Applicants: Scitech Centre, Mumbai (IN); ACG PAM PHARMA TECHNOLOGIES PRIVATE LIMITED, Mumbai (IN)

(72) Inventors: Karan Singh, Mumbai (IN); Vinayak Deshmane, Mumbai (IN); Shivraj Gujela, Mumbai (IN)

( * ) Notice: Subject to any disclaimer, the term of this patent is extended or adjusted under 35 U.S.C. 154(b) by 120 days.

(21) Appl. No.: 17/775,211

(22) PCT Filed: Nov. 3, 2020

(86) PCT No.: PCT/IB2020/060284
§ 371 (c)(1),
(2) Date: May 6, 2022

(87) PCT Pub. No.: WO2021/090150
PCT Pub. Date: May 14, 2021

(65) Prior Publication Data

US 2022/0396383 A1 Dec. 15, 2022

(30) Foreign Application Priority Data

Nov. 6, 2019 (IN) ..... 201921045187

(51) Int. Cl.
*B65B 35/34* (2006.01)
*B65B 5/10* (2006.01)
(Continued)

(52) U.S. Cl.
CPC ..... *B65B 35/34* (2013.01); *B65B 5/103* (2013.01); *B65B 9/045* (2013.01); *B65B 55/24* (2013.01); *B65B 65/02* (2013.01)

(58) Field of Classification Search
None
See application file for complete search history.

(56) References Cited

U.S. PATENT DOCUMENTS 781,395 A 1/1905 Rohdin
3,330,092 A 7/1967 Hill
2020/0391887 A1* 12/2020 Takada ..... G07F 17/0092

FOREIGN PATENT DOCUMENTS

CN 106986074 A 7/2017
CN 208291528 U * 12/2018 ..... B65B 11/52
(Continued)

OTHER PUBLICATIONS

U.S. Appl. No. 10/505,672, filed May 19, 2005, Bernd Hähnel.
(Continued)

*Primary Examiner* — Tanzim Imam

(57) ABSTRACT

The present disclosure relates to a brush box that includes a housing, a gear system (100) configured inside the housing. The gear system (100) includes a first gear (102) having first teeth configured on an inner side of the first gear (102). Second gear (104) configured inside the first gear (102), the second gear (104) includes second teeth that engages with the first teeth such that the first gear (102) configured to rotate about its axis when the at least one second gear (104) moves on the inner side of the first gear (102). Distributing means (106) operatively coupled to the second gear (104). The movement of the second gear (104) circumferentially on the inner side of the first gear (102) enables spirographic movement of the distributing means (106) around a centre of the first gear (102).

6 Claims, 4 Drawing Sheets

(51) Int. Cl.

| | |
|---|---|
| ***B65B 9/04*** | (2006.01) |
| ***B65B 55/24*** | (2006.01) |
| ***B65B 65/02*** | (2006.01) |

(56) References Cited

FOREIGN PATENT DOCUMENTS

| | | | | | |
|---|---|---|---|---|---|
| CN | 208291528 | U | | 12/2018 | |
| CN | 202010340701.5 | A | | 2/2021 | |
| DE | 102004020549 | A1 | | 11/2005 | |
| JP | 2021024636 | A | | 2/2021 | |
| JP | 2019195960 | A | | 5/2021 | |
| WO | WO-2019172317 | A1 | * | 9/2019 | ..... A61J 7/0076 |
| WO | WO2019172317 | A1 | | 9/2019 | |
| WO | PCT/CN2020/077728 | | | 7/2021 | |

OTHER PUBLICATIONS

U.S. Appl. No. 16/784,817, filed Jun. 4, 2020, Yukihiro Taguchi.
U.S. Appl. No. 17/218,956, filed Mar. 31, 2021, Hardy Schmidt-Ellinger.
U.S. Appl. No. 14/856,739, filed Mar. 24, 2016, Peter H. Tillstrom.
U.S. Appl. No. 10/508,555, filed Jun. 30, 2005, Richard Christ.
U.S. Appl. No. 16/233,213, filed May 2, 2019, Naohiko Noda.
U.S. Appl. No. 12,058,908, filed Oct. 2, 2008, Kurt Gnann.
U.S. Appl. No. 14/689,155, filed Oct. 2, 2018, Christoph Hellenbrand.
U.S. Appl. No. 12/275,266, filed Aug. 5, 2009, Josef Bentele.
U.S. Appl. No. 10/906,606, filed Feb. 21, 2012, Tom Ahlkvist Scharfeld.
U.S. Appl. No. 14/354,678, filed Oct. 9, 2014, Alessandro Amaranti.
U.S. Appl. No. 07/975,622, filed Jul. 19, 1994, Stuart C. Bagley.
U.S. Appl. No. 11/698,905, filed Jul. 31, 2008, Tung-Lung Chiang.

* cited by examiner

SPIROFEED BRUSH BOX FOR A BLISTER MACHINE

TECHNICAL FIELD

The present disclosure relates to a field of blister machines and brush box for the blister machines. More particularly, the present disclosure relates to a brush box for a blister machine for filling articles such as tablets, capsules, and other feedable products into depressions of a blistered sheet.

BACKGROUND

Background description includes information that may be useful in understanding the present invention. It is not an admission that any of the information provided herein is prior art or relevant to the presently claimed invention, or that any publication specifically or implicitly referenced is prior art.

Blister machines are widely used in pharmaceutical and packaging industries for packing pharmaceutical products such as tablets, soft gels, pills and capsules, and other feedable products.

Conventional blister machine includes a forming station, in which multiple depressions or cavities or blisters are formed into a sheet for accommodating the pharmaceutical and/or other feedable products. The blistered sheet with multiple depressions then passes through a feeding station where the products to be packaged (pharmaceutical and/or other feedable products) are inserted into each depression of the moving blistered sheet. Later, the blistered sheet having the products in it's depressions is transported to a sealing station. The sealing station enables the disposing and tight sealing of a sealing sheet over the moving blistered sheet, thereby enclosing the pharmaceutical and/or other feedable products in the depressions of the blistered sheet.

The feeding station of the blister machine includes a brush box disposed over the blistered sheet for agitating the products over the moving blistered sheet, thereby facilitating the insertion of the products into the depressions of the blistered sheet. The brush box incorporates several rotary driven brushes positioned over the blistered sheet. The brushes are coupled to a rotary drive and gear box assembly positioned next to the brush box to drive the brushes over the blistered sheet.

A sufficient amount of the products to be packaged are supplied through an upper side of the brush box. The brush box performs the task of distributing and agitating the products over the blistered sheet passing below it, such that the products fall into the depressions of the blistered sheet.

A major drawback of the existing brush box of the conventional blister machine is their reduced efficiency in filling each depression of the moving blistered sheet with the product if the speed of the blistered sheet moving passing beneath the brush box is increased. This leads to empty depressions and a high rejection percentage of the final packaged product.

The brush box of the conventional blister machine incorporates multiple brushes to sweep over each corner of the blistered sheet in order to fill each depression of the blister sheet with the products. Such a large number of brushes require bigger or additional drives (motor and gearbox). This increases the overall size and weight of the brush box, thereby making the brush box costly and difficult to operate and maintain.

Another drawback of the conventional brush box is its inability to handle and package uncoated pharmaceutical products. The movement and rotation of the rotary brushes of the brush box over the uncoated products damage the uncoated product and generates dust in the brush box. This dust production significantly affects the overall packaging process and leads to product and monetary losses. Also, it becomes difficult to handle and remove the damaged products from the blister machine.

There is, therefore, a need to provide an efficient and affordable brush box for a blister machine for filling articles such as tablets (coated and uncoated), capsules, and other feedable products into depressions of a blistered sheet, and that overcomes above stated drawbacks of the conventional brush boxes.

OBJECTS OF THE PRESENT DISCLOSURE

Some of the objects of the present disclosure, which at least one embodiment herein satisfies are as listed herein below.

It is an object of the present disclosure to provide a brush box for a blister machine with better packaging efficiency of articles in blistered sheet.

It is an object of the present disclosure to provide a brush box for a blister machine with distributing means having spirographic movement for better packaging efficiency.

It is an object of the present disclosure to provide a cost-effective brush box for a blister machine.

It is an object of the present disclosure to provide a brush box for a blister machine with improved reliability and lesser maintenance cost.

It is an object of the present disclosure to provide a brush box for a blister machine which is simple and easy to use.

It is an object of the present disclosure to provide a brush box for a blister machine with reduced size.

SUMMARY

The present disclosure relates to a field of blister machines and brush box for the blister machines. More particularly, the present disclosure relates to a brush box for a blister machine for filling articles such as tablets, capsules and other feedable products into depressions of a blistered sheet.

An aspect of the present disclosure pertains to a brush box for a blister machine, the brush box includes a housing, and a gear system configured inside the housing. The gear system includes a ring shaped first gear having a plurality of first teeth configured circumferentially on an inner side of the first gear. At least one second gear configured inside the first gear, the at least one second gear having a plurality of second teeth that engages with the plurality of first teeth such that the first gear is configured to rotate about its axis when the at least one second gear moves on the inner side of the first gear. One or more distributing means operatively coupled to the at least one second gear. The movement of the at least one second gear circumferentially on the inner side of the first gear enables spirographic movement of the one or more distributing means around a center of the first gear.

In an aspect, the gear system may include a third gear, having a plurality of third teeth, may be configured at the center of the one or more second gear, and the third gear may be configured to rotate at its axis upon the rotation of the one or more second gear.

In an aspect, the gear system can include a fourth gear, having the one or more distribution means, may be operatively configured with the third gear, and the fourth gear may include a plurality of fourth teeth configured to be engaged with the plurality of third teeth of the third gear such that the fourth gear rotates circumferentially around the third gear when the third gear rotates.

In an aspect, the one or more distributing means may include any or a combination of a brush, and a shaft with a plurality of flaps.

In an aspect, the brush box may include an electric motor operatively coupled to the at least one second gear and configured to move each of the at least one second gear on the radially inner side of the first gear.

In an aspect, the brush box may be configured to be positioned over a blister sheet comprising a plurality of cavities that may be configured to accommodate one or more articles, and the spirographic movement of the one or more distributing means over the blistered sheet may facilitate distribution of the one or more articles over the blistered sheet, and wherein the distribution of the one or more articles facilitates filling of the one or more articles into the plurality of cavities of the blistered sheet.

In an aspect, the brush box may include a vertical height adjustment means operatively coupled to the first gear to enable vertical motion of the gear system over the blistered sheet, and may adjust the height of the one or more distributing machine over the blistered sheet.

In an aspect, the brush box may include a control unit operatively coupled with the electric motor and the vertical height adjustment means, and may be configured to control a rotational speed and direction of rotation of the at least one second gear and the one or more distribution means, and height of the vertical adjustment means.

In an aspect, the brush box may include a dust collection system configured with the brush box, and configured to collect dust generate while the distribution of the one or more articles.

In an aspect, the housing may include a storage unit for storing the one or more articles, and may be configured to deliver, in a controlled way, the one or more articles over the blistered sheet.

Various objects, features, aspects and advantages of the inventive subject matter will become more apparent from the following detailed description of preferred embodiments, along with the accompanying drawing figures in which like numerals represent like components.

BRIEF DESCRIPTION OF DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure. The diagrams are for illustration only, which thus is not a limitation of the present disclosure.

In the figures, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

DETAILED DESCRIPTION

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the present disclosure as defined by the appended claims.

In the following description, numerous specific details are set forth in order to provide a thorough understanding of embodiments of the present invention. It will be apparent to one skilled in the art that embodiments of the present invention may be practiced without some of these specific details.

The present disclosure relates to a field of blister machines and brush box for the blister machines. More particularly, the present disclosure relates to a brush box for a blister machine for filling articles such as tablets, capsules, and other feedable products into depressions of a blistered sheet.

Figure 1A:
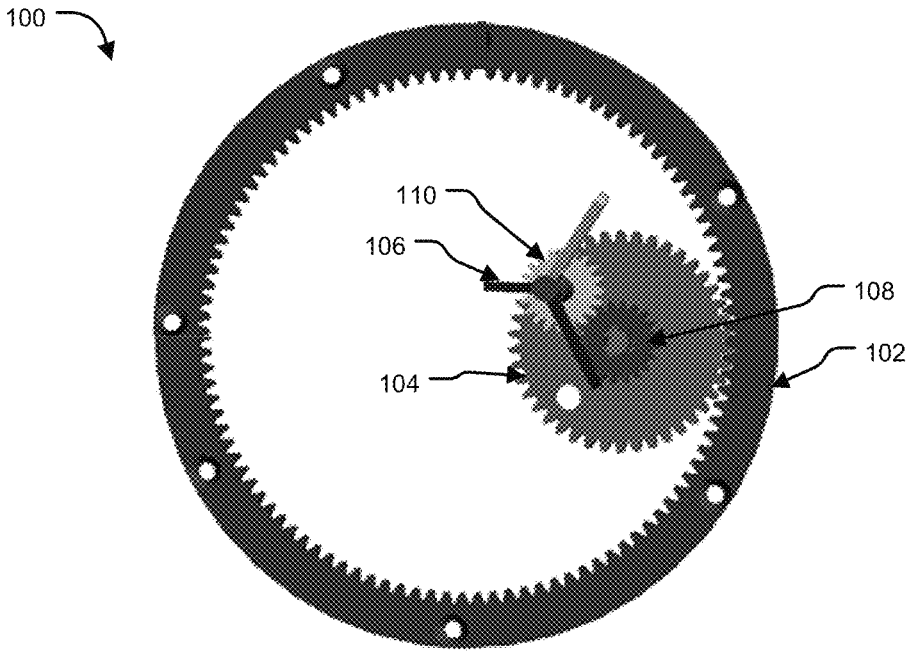
FIGS. 1A and 1B illustrate exemplary views of gear system of the proposed brush box, in accordance with an embodiment of the present disclosure.
Figure 1B:
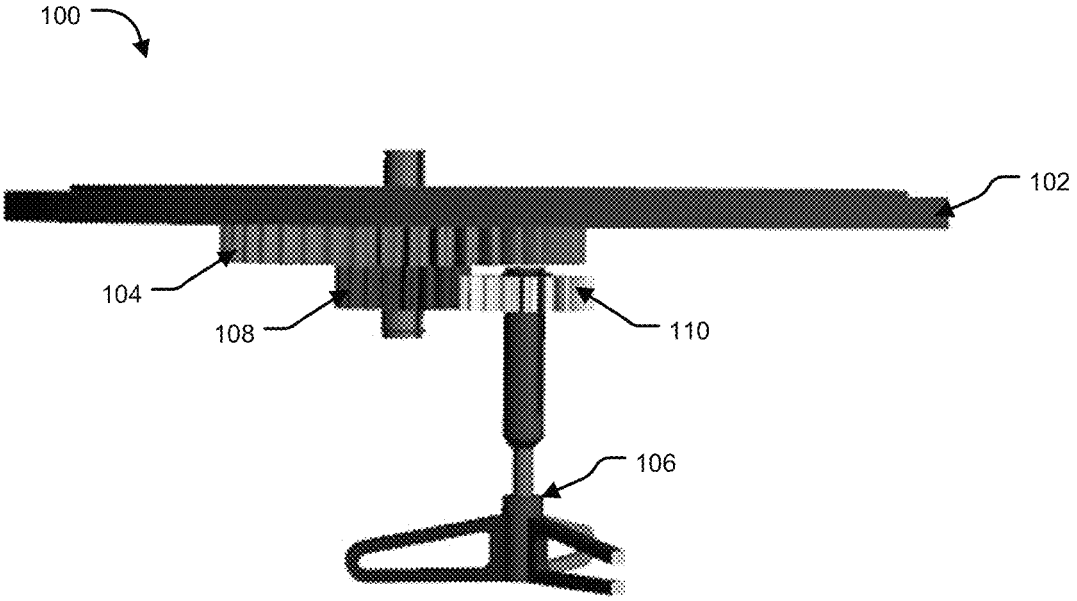

FIGS. 1A and 1B illustrate exemplary views of an exemplary gear system of the proposed brush box, in accordance with an embodiment of the present disclosure to elaborate upon its working.

In an embodiment, the present disclosure elaborates on a brush box for a blister machine. The brush box can include a housing, a gear system 100 can be configured inside the housing. The gear system 100 can include a ring shaped first gear 102 having a plurality of first teeth can be configured circumferentially on an inner side of the first gear 102. At least one second gear 104 can be configured inside the first gear 102, and the at least one second gear 104 can include a plurality of second teeth that engages with the plurality of first teeth such that the first gear 102 can be configured to rotate about its axis when the at least one second gear 104 moves on the inner side of the first gear 102. One or more distributing means 106 can be operatively coupled to the at least one second gear 104. The movement of the at least one second gear 104 circumferentially on the inner side of the first gear 102 can enable spirographic movement of the one or more distributing means 106 around a center of the first gear 102.

In an embodiment, the gear system 100 can include a third gear 108, having a plurality of third teeth, can be configured at the center of the one or more second gear 104, and can be configured rotate at its axis with the rotation of the one or more second gear 104. The third gear 108 can be fixed at the center of the one or more second gear 104. The gear system 100 can include a fourth gear 110, having the one or more distribution means 106, can be operatively configured with the third gear. The fourth gear 110 can include a plurality of fourth teeth configured to be engaged with the plurality of third teeth such that the fourth gear 110 can rotate circumferentially around the third gear 108 when the third gear 108 rotates.

In an embodiment, the one or more distributing means 106 can include any or a combination of a brush, and a shaft 308 with a plurality of flaps 310. The distribution means 306 can be configured to rotate at their own axis for enhanced distribution of the one or more articles into cavities of the blistered sheet. The brush box can include an electric motor 304 that can be operatively coupled to the at least one second gear 104 and configured to move each of the at least one second gear 104 on the radially inner side of the first gear 102. The brush box can include a height adjustment means that can be operatively coupled to the first gear 102 to enable vertical motion of the gear system 100 over a blistered sheet, and adjust the height of the one or more distributing means 106 over the blister sheet.

In an embodiment, the blistered sheet can include a plurality of cavities in it for accommodating the one or more articles into the cavities. The spirographic movement of the one or more distributing means 106 over the blistered sheet can facilitate distribution of the one or more article over the blistered sheet, and the distribution of the one or more articles over the blistered sheet can facilitate filling of the one or more articles into the plurality of cavities of the blistered sheet. The brush box can include a control unit operatively coupled with the electric motor 304 and the height adjustment means. The control unit can be configured to control a rotational speed and direction of the at least one second gear 104 and the one or more distribution means 106, and the height of the one or more distribution means over the blister sheet. The brush box can include a dust collection system configured with the brush box, and configured to collect dust generate while the distribution of the one or more articles. Further, the housing can include a storage unit for storing the one or more articles, and can be configured to deliver, in a controlled way, the one or more articles over the blistered sheet.

Figure 2:
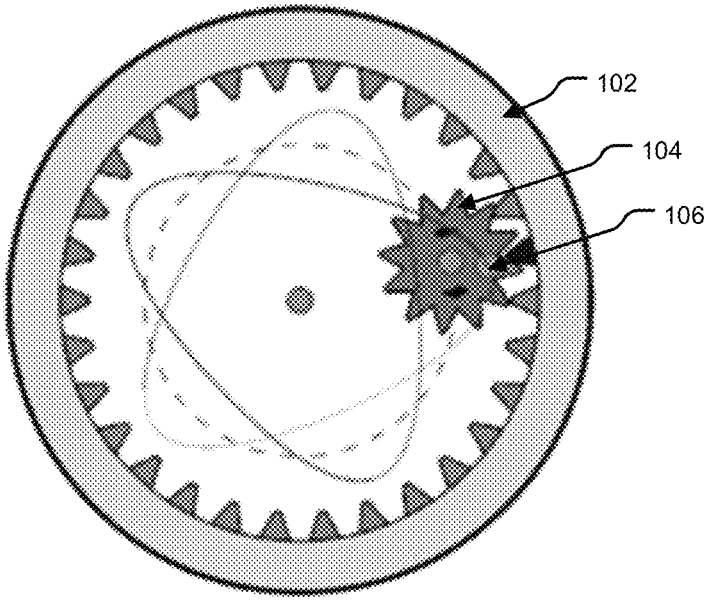
FIG. 2 illustrates an exemplary path covered by the agitating means during their spirographic movement inside the ring shaped first gear of the proposed brush box, in accordance with an embodiment of the present disclosure.

FIG. 2 illustrates an exemplary path covered by the agitating means during their spirographic movement inside the ring shaped first gear of the proposed brush box, in accordance with an embodiment of the present disclosure.

As illustrated, the second gear 104 can be configured to move circumferentially on the inner side of the first gear 102. The second gear 104 can follow a circular path (depicted by dotted line in FIG. 2) along the inner side of the first gear 102, around the centre of the first gear 102.

In an embodiment, the movement of the second gear 104 circumferentially on the inner side of the first gear 102 can enable spirographic movement of the agitating means 106 around the center of the first gear 102. The agitating means 106 can follow a spirographic path (depicted by solid lines in FIG. 2) inside the first gear 102.

Figure 3:
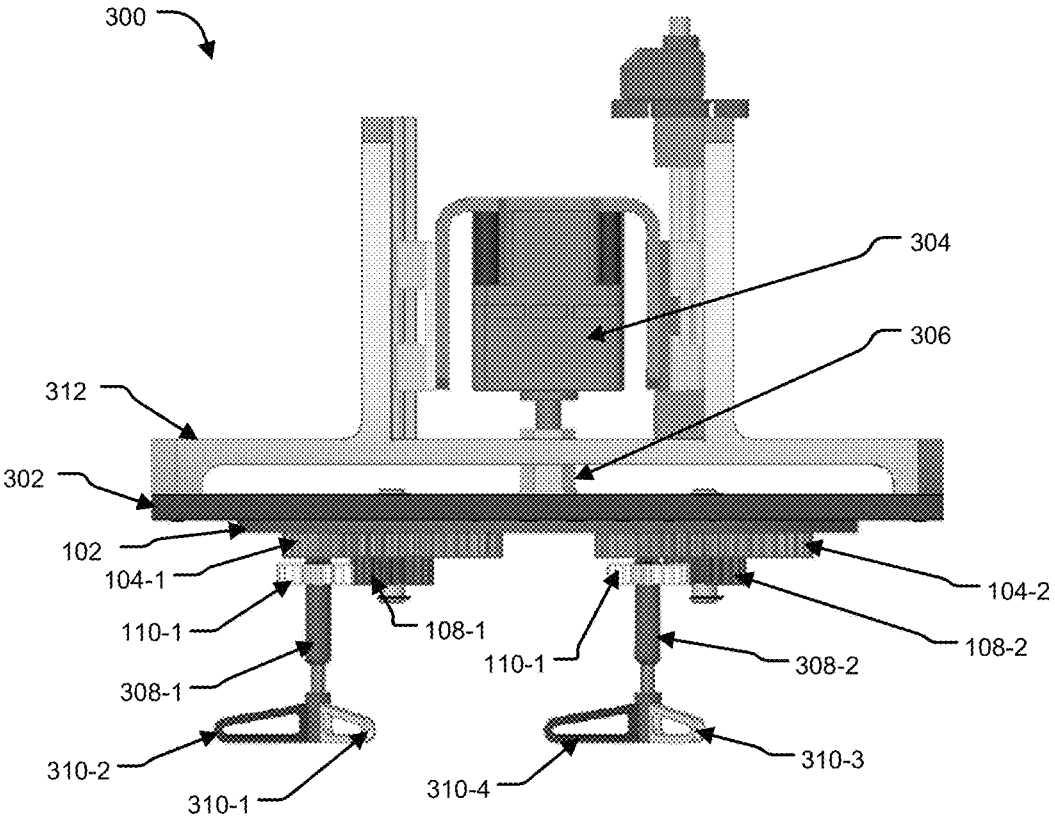
FIG. 3 illustrates an exemplary view of the proposed brush box, in accordance with an embodiment of the present disclosure.

FIG. 3 illustrates an exemplary view of the proposed brush box, in accordance with an embodiment of the present disclosure.

As illustrated, in an aspect, the proposed brush box 300 can include the gear system 100, which can include the ring shaped first gear 102 having a plurality of first teeth configured circumferentially on an inner side of the first gear 102. The brush box 300 can include the at least one second gear 104-1, 104-2 (collectively referred to as second gears 104, herein) configured inside the first gear 102. The second gears 104 can have a plurality of second teeth that can engage with the plurality of first teeth such that the second gears 104 can be configured to rotate about its axis when the second gears 104 moves on the inner side of the first gear 102.

In an embodiment, the brush box 300 can include one or more agitating means 106 (also referred to as distributing means or agitating means, herein) that can be coupled to the second gears such that the movement of the second gears 104 circumferentially on the inner side of the first gear 102 can enable spirographic movement of the corresponding agitating means 106 around a center of the first gear. In an exemplary embodiment, the agitating means 106 can be any or a combination of a brush, and a shaft 308 with multiple flaps 310, but not limited to the likes.

In an implementation, the brush box 300 can be positioned above a blister sheet (web) such that the agitating means 106 can have a suitable clearance over the blister sheet and the agitating means 106 can move in the spirographic motion above the blister sheet. The blister sheet can include a plurality of depressions (also referred to as depressions or cavities or blisters, herein) for accommodating one or more articles. The blister sheet can be configured to move or pass below the brush box at a predefined speed depending on the number of articles to be filled per minute in the depressions of the blister sheet.

In an embodiment, the spirographic movement of the agitating means 106 over the blistered sheet can facilitate agitation of the one or more articles over the blistered sheet. Further, the agitation of the articles facilitates filling of the articles into the depressions of the blistered sheet. In an exemplary embodiment, the articles can be the products to be packaged in the blister sheet, which can be any or a combination of pharmaceutical products such as tablets, soft gels, pills and capsules, and other feedable products, but not limited to the likes. The tablets can be any or a combination of coated and uncoated tablets.

In an exemplary embodiment, the pharmaceutical products can include tablets of shapes that can be any or a combination of flat, bi-convex, sphere, caplet bi-convex, oval bi-convex, octagonal flat, rectangular, rhombus bi-convex, and special shape bi-convex, but not limited to the likes. The pharmaceutical products can include soft gelatine capsules and hard gelatine capsules of shapes that can be any or a combination oblong, oval, and bi-convex, but not limited to the likes.

In an exemplary embodiment, a sufficient amount of the products to be packaged can be supplied through the upper side of the brush box 300. The brush box 300 can perform the task of distributing and agitating the products over the blistered sheet passing below it using the spirographic movement of the agitating means 106, such that the products can fall into the depressions of the blistered sheet.

In an embodiment, the second gears 104 can include an assembly of third gears 108-1, 108-2 (collectively referred to as third gears 108 and fixed gears 108, herein) and fourth gears 110-1, 110-2 (collectively referred to as fourth gear 110 or flap gears, herein) coupled to it. The fixed gears 108 can be mounted on the center of the second gear 104 such that the fixed gears 108 can rotate together with the second gear 104. The flap gears 110 can be engaged circumferentially around the fixed gear 108 such that the flap gears can rotate about its axis when the fixed gear 108 or the second gear 104 rotate about their axis.

In an embodiment, the agitating means 106 can be coupled to the flap gears 110 such that the agitating means 106 can rotate along with the flap gears 110 when the fixed gear 108 or the second gear 104 rotate about their axis. The movement of the second gear 104 circumferentially on the inner side of the first gear 102 can enable spirographic movement of the flap gears 110 and the agitating means 106 around the center of the first gear 102 to facilitate agitation of the products to be packaged over the blistered sheet. The agitation of the products to be packaged can facilitate the filling of the product into the depressions of the blistered sheet.

In an embodiment, the gear system 100 can be fixed to a base plate 302. The base plate 302 can include a circular cut section of suitable diameter so as to accommodate the ring shaped first gear 102 to it. The cut section of the base plate 302 can facilitate the second gears 104 to move freely inside the first gear 102.

In an embodiment, the brush box 100 can include one or more electrical motor 304 (also referred to as electrical motor 304, herein) operatively coupled to the second gears 104 such that the electric motor 304 can enable movement of each of the second gears 104 on the circumferential inner side of the first gear 102. In an embodiment, each of the second gears 104 can be coupled together to the electrical motor 304 by a rotor 306 such that the rotor 306 can be configured to move each of the second gears 104 together on the inner side of the first gear 102.

In an another embodiment, a single rotor 306 can be configure with each of the second gears 304 such that the rotation provided by the electrical motor 304 can enable the rotor 306 to rotate each of the second gears 104 together on the inner side of the first gear 102.

In an embodiment, the brush box 300 can include a motor control unit operatively coupled to the electrical motor 304 and configured to adjust one or more motor parameters of the electrical motor 304. In an exemplary embodiment, the one or more motor parameters controlled by the motor control unit can be any or a combination of the speed of the electrical motor and direction of rotation of the electrical motor 304.

In an embodiment, the speed of the electrical motor 304 or the agitating means 106 can be adjusted based on the shape, number, and type of the articles or products to be packaged. The number of agitating means 106 can be increased whenever higher efficiency of articles being filled in the depressions of the blister sheet is required.

In an exemplary embodiment, the spirographic movement of the agitating means 106 can be directly tangential to the surface of the blister sheet or at the desired height above the blister sheet or a combination thereof.

In an embodiment, the agitating means 106 can include a plurality of flaps 310-1 to 310-4 (collectively referred to as flaps 310, herein) coupled to the flap gears 110 by a plurality of shafts 308-1, 308-2 (collectively referred to as shafts 308, herein). For instance, one of the agitating means including the flaps 310-1 and 310-2 can be coupled to the flap gear 110-1 by the shaft 308-1, and another agitating means including the flaps 310-3 and 310-4 can be coupled to the flap gear 110-2 by the shaft 308-2.

In an embodiment, the brush box 300 can include a dust collection system configured with the brush box to collect dust generate due to the agitation of uncoated articles. In an exemplary embodiment, the reduced size of the brush box can facilitate accommodation of the dust collection system with the brush box.

Figure 4:
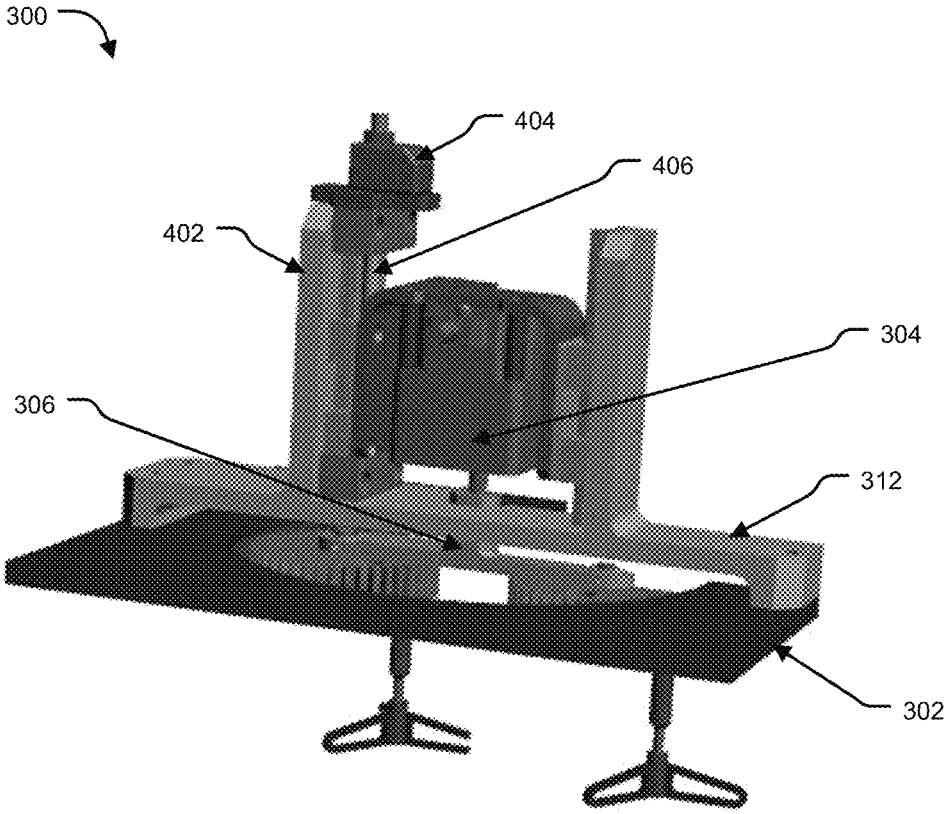
FIG. 4 illustrates an exemplary height adjustment mechanism of the proposed brush box, in accordance with an embodiment of the present disclosure to elaborate its working.

FIG. 4 illustrates an exemplary height adjustment mechanism of the proposed brush box, in accordance with an embodiment of the present disclosure to elaborate its working.

As illustrated, the brush box can include a height control unit 404 configured to any or a combination of the gear system 100, the electrical motor 304, the agitating means 106 to enable vertical adjustment of the agitating means 106 in reference to the base plate 302 or the blister sheet. The height control unit 404 can facilitate height adjustment of the agitating means at a desired height above the blister sheet passing below the brush box.

In an embodiment, the brush box 300 can include a motor mounting bracket 312 mounted on the base plate 302 and configured to accommodate the electrical motor 304 and the motor control unit.

In an embodiment, the motor mounting bracket 312 can include at least two arms 402-1, 402-2 (also referred to as arms 402, herein) extending along each side of the electrical motor 304 such that the electrical motor 304 can be positioned and slidably configured between the arms 402. Each of the arms 402 can include a sliding means 406-1, 406-2 to slidably couple the electrical motor 304 to the arms 402 of the motor mounting bracket 312. The height adjustment control unit can include actuators to enable sliding of the electrical motor on the sliding means and fix the electrical motor and the agitating means at the desired height above the blister sheet.

For instance, the sliding means 406-1 can be configured with the arm 402-1, and the sliding means 406-2 can be configured with the arm 402-2.

In an implementation, the spirographic movement of the agitating 106 above the blister sheet and the height adjustment of the agitating means at the predefined height above the blister sheet can increase the probability of the articles to fill each of the depressions of the blister sheet passing below the brush box (or held stationary below the brush box).

In an embodiment, the proposed brush box can include an auxiliary motor operatively coupled to the one or more distribution means 106, for rotation of the one or more distribution means 106 at their axis just in case the main motor 304 is not working. The auxiliary motor can be operatively coupled to the shaft 308 of each of the one or more distribution means 106 to facilitate rotation of the corresponding flaps 310 about the shaft 308. In this way, the one or more distribution means 106 can still provide some distribution the one or more articles when the one or more second gears 104 are not rotating. Also, the brush box can include a handle that is operatively connected to the one or more second gears 104 for the manual actuation of the one or more second gears in case of power failure.

Figure 5:
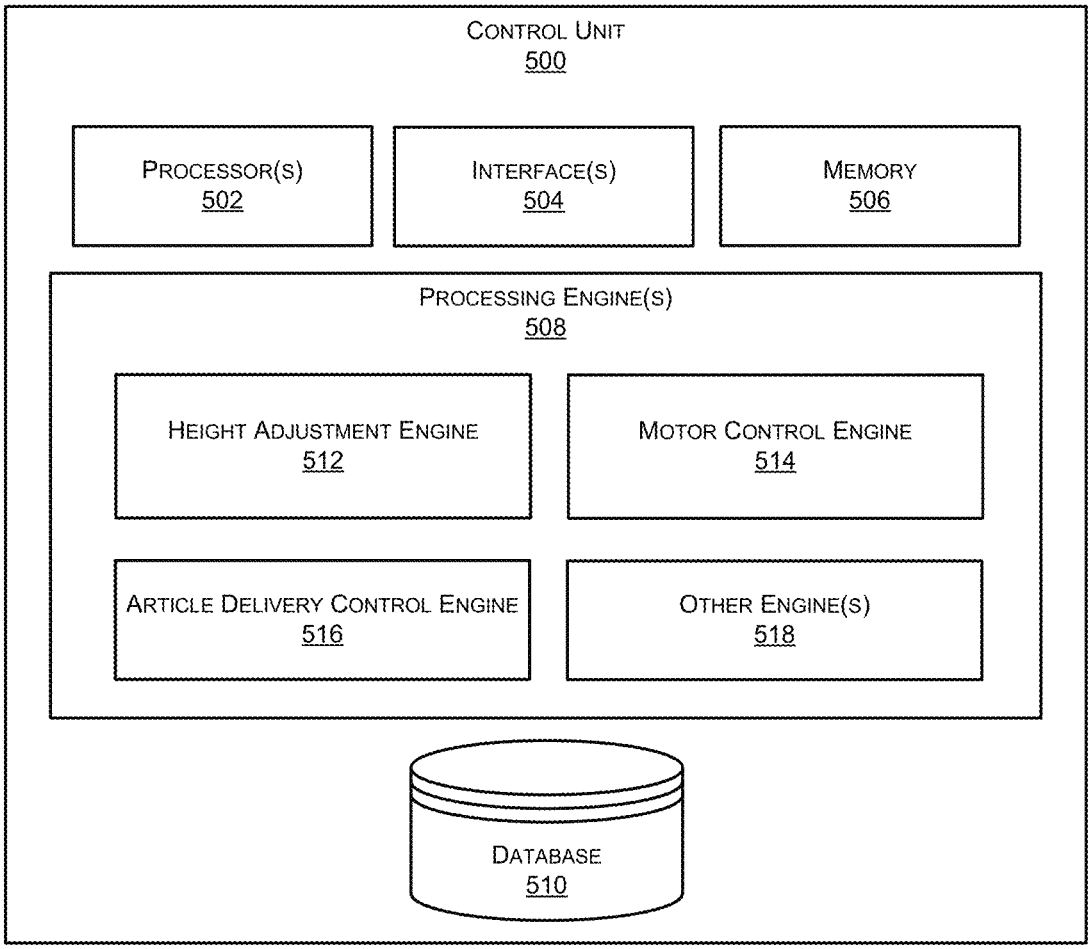
FIG. 5 illustrates an exemplary module diagram of a control unit of the proposed system, in accordance with an embodiment of the present disclosure

FIG. 5 illustrates an exemplary module diagram of a control unit of the proposed system, in accordance with an embodiment of the present disclosure.

As illustrated, an exemplary module diagram of the control unit 500, associated with the proposed brush box, that include one or more processor(s) 502. The one or more processor(s) 502 can be implemented as one or more microprocessors, microcomputers, microcontrollers, digital signal processors, central processing units, logic circuitries, and/or any devices that manipulate data based on operational instructions. Among other capabilities, the one or more processor(s) 502 are configured to fetch and execute computer-readable instructions stored in a memory 506 of the control unit 500. The memory 506 can store one or more computer-readable instructions or routines, which may be fetched and executed to create or share the data units over a network service. The memory 506 can include any non-transitory storage device including, for example, volatile memory such as RAM, or non-volatile memory such as EPROM, flash memory, and the like.

The control unit 500 can also include an interface(s) 504. The interface(s) 504 can comprise a variety of interfaces, for example, interfaces for data input and output devices, referred to as I/O devices, storage devices, battery charging and the like. The interface(s) 504 can facilitate communication of control unit 500 with the brush box. The interface(s) 504 can also provide a communication pathway for one or more components of the control unit 502. Examples of such components include, but are not limited to, processing engine(s) 508 and data 210.

The processing engine(s) 508 can be implemented as a combination of hardware and programming (for example, programmable instructions) to implement one or more functionalities of the processing engine(s) 508. In examples described herein, such combinations of hardware and programming may be implemented in several different ways. For example, the programming for the processing engine(s) 508 can be processor executable instructions stored on a non-transitory machine-readable storage medium and the hardware for the processing engine(s) 508 can comprise a processing resource (for example, one or more processors), to execute such instructions. In the present examples, the machine-readable storage medium can store instructions that, when executed by the processing resource, implement the processing engine(s) 508. In such examples, the control unit 500 can comprise the machine-readable storage medium storing the instructions and the processing resource to execute the instructions, or the machine-readable storage medium may be separate but accessible to control unit 500 and the processing resource. In other examples, the processing engine(s) 508 can be implemented by electronic circuitry.

Data 510 can comprise data that is either stored or generated as a result of functionalities implemented by any of the components of the processing engine(s) 208 the control unit 500. The control unit 500 can be configured for controlling various parameters (e.g. speed and direction of rotation of the motor, height adjustment) of the proposed brush box. In order to perform the above-mentioned verification, the control unit 500 can include a height adjustment engine 512, which can be configured to adjust the height of the gear system 100 over the blister sheet. The control unit 500 can execute a set of first instructions and correspondingly send a set of first control signals to the height control unit 404. Based on the received set of first control signals, the height control unit 404 can vary the height of the gear system 100 over the blistered sheet.

In an embodiment, a motor control engine 514 can be configured to control rotational speed and direction of rotation of the electric motor 304 associated with the proposed brush box. The control unit 500 can execute a set of second instructions and correspondingly send a set of second control signals to the electric motor 304. Based on the received set of second control signals, the rotational speed and direction of rotation of the electric motor 304 can be varied.

In an embodiment, an article delivery control engine 516 can be configured to control the delivery of the one or more articles from the storage unit on the blistered sheet. The delivery of the one or more articles on the blistered sheet can be controlled such that the one or more articles do not spill from the blistered sheet. The one or more articles can be delivered in such a way that only a pre-defined number of articles are released from the storage unit at a time, for delivering over the blistered sheet. The storage unit can include an outlet configured with a valve. The valve can be operatively coupled to the control unit 500. The control unit 500 can execute a set of second instructions and correspondingly send a set of third control signals to the valve of the storage unit. Based on the received set of third control signals, the valve can vary the delivery rate of the one or more articles from the storage unit to the housing.

In an embodiment, the proposed bush box can include an input device that can be operatively configured with the control unit 500. The input device can be either local or can be remotely configured with the control unit 500. The input device can include but without limiting to any or combination of touch display, keypad, and voice operated devices, etc. The input device can be associated with one or more user, and one or more users can send instructions, through the input device, to the control unit 500 for customized operation of the brush box as required. In an exemplary embodiment, the control unit 500 can include a communication module, configured to communicatively couple the input device associated with the users to the brush box. The input device can also include a communication module to facilitate the transmission of the instructions provided by the users to the control unit 500, in form of data-packet or signals.

Moreover, in interpreting the specification, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

While the foregoing describes various embodiments of the invention, other and further embodiments of the invention may be devised without departing from the basic scope thereof. The scope of the invention is determined by the claims that follow. The invention is not limited to the described embodiments, versions or examples, which are included to enable a person having ordinary skill in the art to make and use the invention when combined with information and knowledge available to the person having ordinary skill in the art.

Advantages of the Invention

The proposed invention provides a brush box for a blister machine with better packaging efficiency of articles in blistered sheet.

The proposed invention provides a brush box for a blister machine with distributing means having spirographic movement for better packaging efficiency.

The proposed invention provides a cost-effective brush box for a blister machine.

The proposed invention provides a brush box for a blister machine with improved reliability and lesser maintenance cost.

The proposed invention provides a brush box for a blister machine which is simple and easy to use.

The proposed invention provides a brush box for a blister machine with reduced size.

We claim:

1. A brush box for a blister machine, the brush box comprising:

a housing; and a gear system (100) configured inside the housing, the gear system (100) including:

a ring shaped first gear (102) having a plurality of first teeth configured circumferentially on an inner side of the first gear (102);

at least one second gear (104) configured inside the first gear (102), the at least one second gear (104) having a plurality of second teeth that engages with the plurality of first teeth such that the first gear (102) is configured to rotate about its axis when the at least one second gear (104) moves on the inner side of the first gear (102);

a third gear (108), having a plurality of third teeth, configured at a center of the at least one second gear (104), and wherein the third gear (108) is configured to rotate about its axis upon rotation of the at least one second gear (104);

one or more distributing means (106) operatively coupled to the at least one second gear (104), wherein movement of the at least one second gear (104) circumferentially on the inner side of the first gear (102) enables spirographic movement of the one or more distributing means (106) around a center of the first gear (102); and a fourth gear (110), having the one or more distributing means (106), operatively configured with the third gear (108), and wherein the fourth gear (110) includes a plurality of fourth teeth configured to be engaged with the plurality of third teeth of the third gear (108) such that the fourth gear (110) rotates circumferentially around the third gear (108) when the third gear rotates (108).

2. The brush box as claimed in claim 1, wherein the one or more distributing means (106) includes any or a combination of a brush, and a shaft (308) with a plurality of flaps (310).

3. The brush box as claimed in claim 1, wherein the brush box includes an electric motor (304) operatively coupled to the at least one second gear (104) and configured to move each of the at least one second gear (104) on the inner side of the first gear (102).

4. The brush box as claimed in claim 1, wherein the brush box is configured to be positioned over a blister sheet including a plurality of cavities that are configured to accommodate one or more articles, wherein the spirographic movement of the one or more distributing means (106) over the blister sheet facilitates distribution of the one or more articles over the blister sheet, and wherein the distribution of the one or more articles facilitates filling of the one or more articles into the plurality of cavities of the blister sheet.

5. The brush box as claimed in claim 1, wherein the brush box (300) includes a dust collection system configured with the brush box, and configured to collect dust generated during distribution of one or more articles.

6. The brush box as claimed in claim 1, wherein the brush box includes a storage unit for storing one or more articles, and is configured to deliver, in a controlled way, the one or more articles over a blister sheet.

* * * * *